US011561485B2

(12) United States Patent
Kawakami et al.

(10) Patent No.: US 11,561,485 B2
(45) Date of Patent: Jan. 24, 2023

(54) DEVELOPING APPARATUS TO INCREASE ADHESION BETWEEN A SEAL MEMBER AND A REGULATION PORTION IN THE DEVELOPING APPARATUS

(71) Applicant: CANON KABUSHIKI KAISHA, Tokyo (JP)

(72) Inventors: Takuya Kawakami, Shizuoka (JP); Yu Fukasawa, Tokyo (JP); Yuji Kawaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/534,280

(22) Filed: Nov. 23, 2021

(65) Prior Publication Data

US 2022/0082958 A1 Mar. 17, 2022

Related U.S. Application Data

(63) Continuation of application No. 17/122,972, filed on Dec. 15, 2020, now Pat. No. 11,204,565.

(30) Foreign Application Priority Data

Dec. 27, 2019 (JP) ..... JP2019-239032

(51) Int. Cl.
*G03G 15/08* (2006.01)

(52) U.S. Cl.
CPC ..... *G03G 15/0812* (2013.01); *G03G 15/0817* (2013.01); *G03G 15/0818* (2013.01); *G03G 15/0898* (2013.01)

(58) Field of Classification Search
CPC ..... G03G 15/0812; G03G 15/0817; G03G 15/0818; G03G 15/0898
See application file for complete search history.

(56) References Cited

U.S. PATENT DOCUMENTS

| | | | | |
|---|---|---|---|---|
| 11,204,565 | B2 * | 12/2021 | Kawakami | G03G 15/0818 |
| 2009/0274481 | A1 * | 11/2009 | Xu | G03G 15/0817 399/103 |
| 2014/0064777 | A1 * | 3/2014 | Toba | G03G 15/0817 399/103 |
| 2016/0259271 | A1 * | 9/2016 | Ooyoshi | G03G 15/0817 |
| 2017/0357189 | A1 * | 12/2017 | Mizukoshi | G03G 15/0812 |
| 2020/0285170 | A1 * | 9/2020 | Yada | G03G 15/0817 |

* cited by examiner

*Primary Examiner* — Sophia S Chen
(74) *Attorney, Agent, or Firm* — Canon U.S.A., Inc. I.P. Division

(57) ABSTRACT

A developing apparatus for use in an image forming apparatus includes a developing frame, a rotatable developing member, a regulation blade to regulate developer borne on a developing member surface, and a seal member to prevent developer from leaking outside the developing frame. The regulation blade includes a support plate, a plate-shaped member, and a regulation member. The seal member is fixed to a facing surface of the plate-shaped member, is arranged at a plate-shaped member end portion, is arranged side by side with the regulation member in a rotational axis direction, contacts an end surface of the regulation member, and is disposed between the plate-shaped member and the developing member in a direction intersecting with the rotational axis direction. The plate-shaped member is welded to a region of the support plate excluding a region outside the end surface of the regulation member in the rotational axis direction.

4 Claims, 10 Drawing Sheets

DEVELOPING APPARATUS TO INCREASE ADHESION BETWEEN A SEAL MEMBER AND A REGULATION PORTION IN THE DEVELOPING APPARATUS

CROSS REFERENCE TO RELATED APPLICATIONS

This application is a continuation of U.S. patent application Ser. No. 17/122,972, filed on Dec. 15, 2020, which claims priority from Japanese Patent Application No. 2019-239032, filed Dec. 27, 2019, each of which are hereby incorporated by reference herein in their entirety.

BACKGROUND OF THE DISCLOSURE

Field of the Disclosure

The present disclosure relates to a developing apparatus for use in an image forming apparatus.

Description of the Related Art

A developing apparatus for use in an image forming apparatus has a configuration described below.

Japanese Patent Application Laid-Open No. 2018-60033 discusses a developing apparatus that includes a developing member and a regulation blade. The developing member bears a developer on the surface thereof and is rotatable. The regulation blade regulates a layer thickness of the developer borne on the surface of the developing member. A flexible regulation portion such as a rubber member or resin material is formed at a leading edge portion of the regulation blade. The developing apparatus further includes a seal member that is in contact with the regulation portion in a rotational axis direction of the developing member and is disposed between the developing member and the regulation blade.

In such a developing apparatus, the seal member is in tight contact with the regulation portion to prevent the developer from leaking to the outside of the developing apparatus from the end portions of the regulation portion in the rotational axis direction of the developing member.

However, in the developing apparatus having the configuration discussed in Japanese Patent Application Laid-Open No. 2018-60033, the developer may leak from between the seal member and the regulation portion in a case where the seal member is not fully in tight contact with the regulation portion in the rotational axis direction of the developing member.

SUMMARY OF THE DISCLOSURE

The present disclosure is directed to a technique for increasing adhesion between a seal member and a regulation portion in a developing apparatus.

According to an aspect of the present disclosure, a developing apparatus for use in an image forming apparatus includes a developing frame configured to accommodate a developer, a developing member configured to bear the developer and be rotatable, a regulation blade configured to regulate the developer borne on a surface of the developing member, wherein the regulation blade is fixed to the developing frame, and a seal member configured to prevent the developer from leaking outside the developing frame, wherein the regulation blade includes: a support plate extending in a rotational axis direction of the developing member, a plate-shaped member having one end portion and other end portion in a direction intersecting with the rotational axis direction, wherein the one end portion faces the developing member and the other end portion is supported by the support plate, and a regulation member configured to regulate the developer borne on the surface of the developing member, wherein the regulation member is fixed to a facing surface of the plate-shaped member facing the developing member at the one end portion, is in contact with the developing member, and is formed inside an end portion of the plate-shaped member in the rotational axis direction, wherein the seal member is fixed to the facing surface of the plate-shaped member, is arranged at the end portion of the plate-shaped member, is arranged side by side with the regulation member in the rotational axis direction, is in contact with an end surface of the regulation member, and is disposed between the plate-shaped member and the developing member in the direction intersecting with the rotational axis direction, and wherein the plate-shaped member is welded to a region of the support plate excluding a region outside the end surface of the regulation member in the rotational axis direction.

Further features of the present disclosure will become apparent from the following description of exemplary embodiments with reference to the attached drawings.

DESCRIPTION OF THE EMBODIMENTS

Exemplary embodiments of the present disclosure will be described in detail below with reference to the drawings. Unless otherwise specified, functions, materials, shapes, and relative positions of components that are described in the exemplary embodiments are not intended to limit the scope of the present disclosure. Further, unless otherwise specified, a function, material, or shape of a member that is described somewhere in the present specification applies thereafter.

Hereinafter, a direction in which a shaft line of a developing roller extends will be referred to as a "first direction", "longitudinal direction", or "rotational axis direction". In addition, a direction that intersects with the first direction and is a vertical direction in a state where an image forming apparatus is placed on a horizontal surface will be referred to as a "second direction". Furthermore, a direction that intersects with the first and second directions will be referred to as a "third direction". The first and second directions intersect with each other and are desirably perpendicular to each other. The second and third directions intersect with each other and are desirably perpendicular to each other. The third and first directions intersect with each other and are desirably perpendicular to each other. Hereinafter, the side of the image forming apparatus where a front door is provided will be referred to as the front side, and the side opposite to the front side will be referred to as the back side. Furthermore, the left side of the image forming apparatus viewed from the front side will be referred to as the drive side", and the right side of the image forming apparatus viewed from the front side will be referred to as the non-drive side.

A developing apparatus according to a first exemplary embodiment of the present disclosure will be described below with reference to the drawings.

<<Configuration of Image Forming Apparatus>>>

Figure 2:
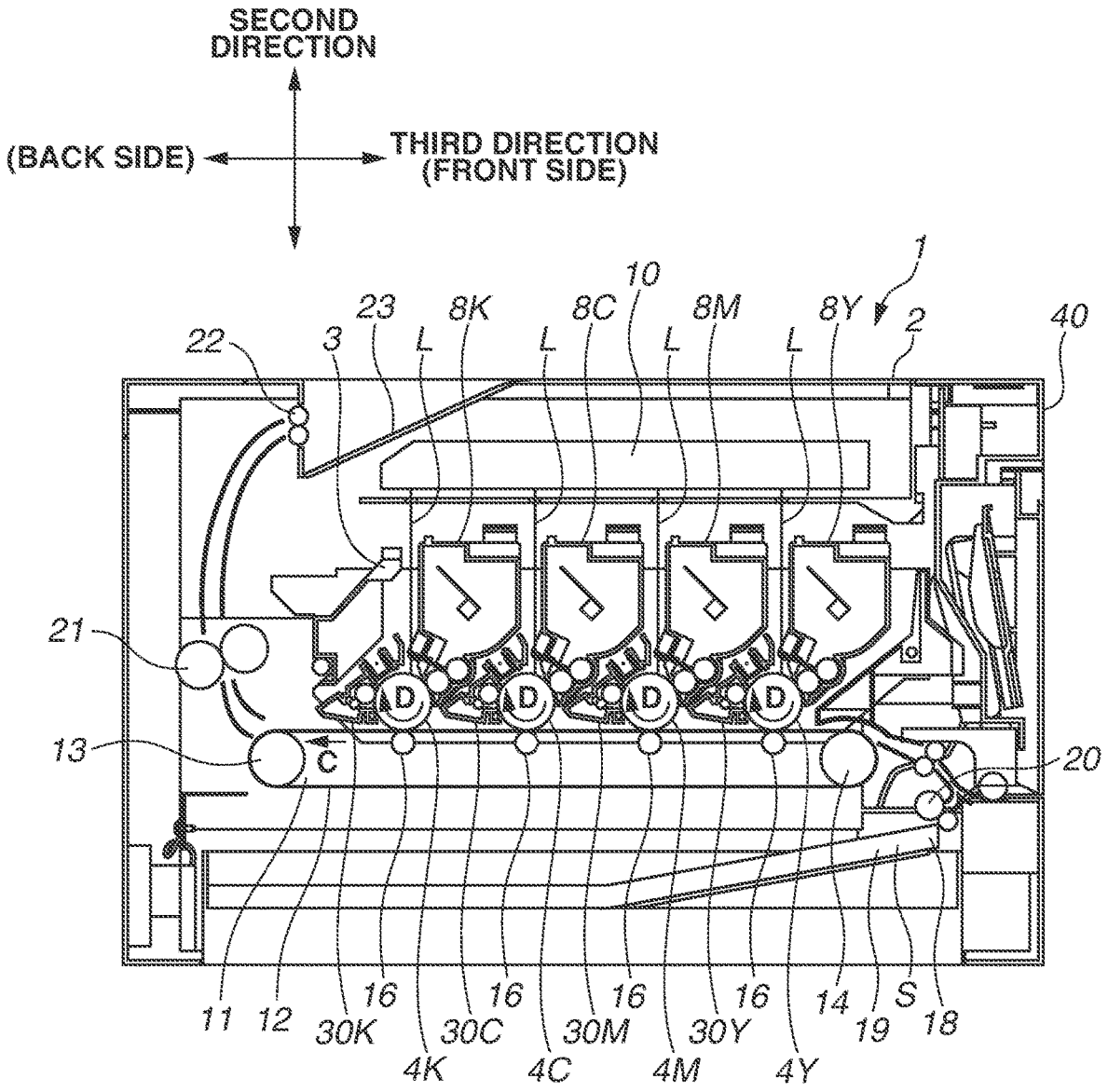
FIG. 2 is a cross sectional view illustrating an image forming apparatus according to the first exemplary embodiment.
Figure 3A:
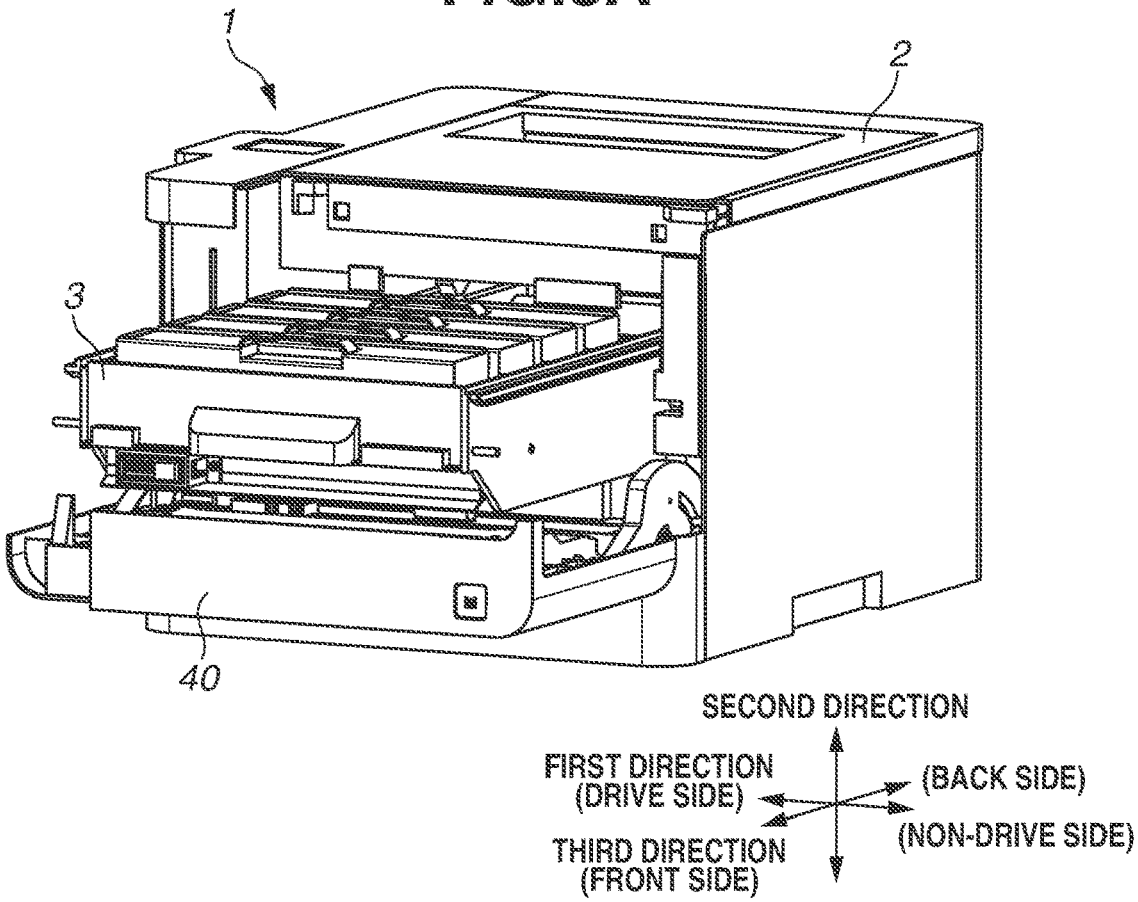
FIGS. 3A and 3B are perspective views each illustrating the image forming apparatus according to the first exemplary embodiment.
Figure 3B:
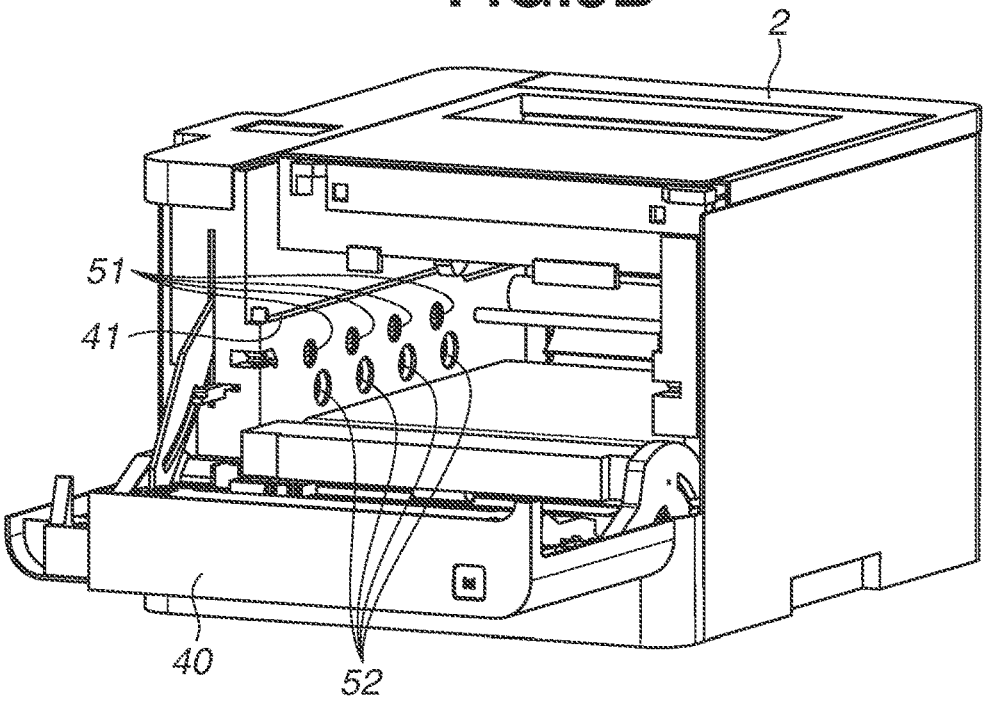
Figure 4:
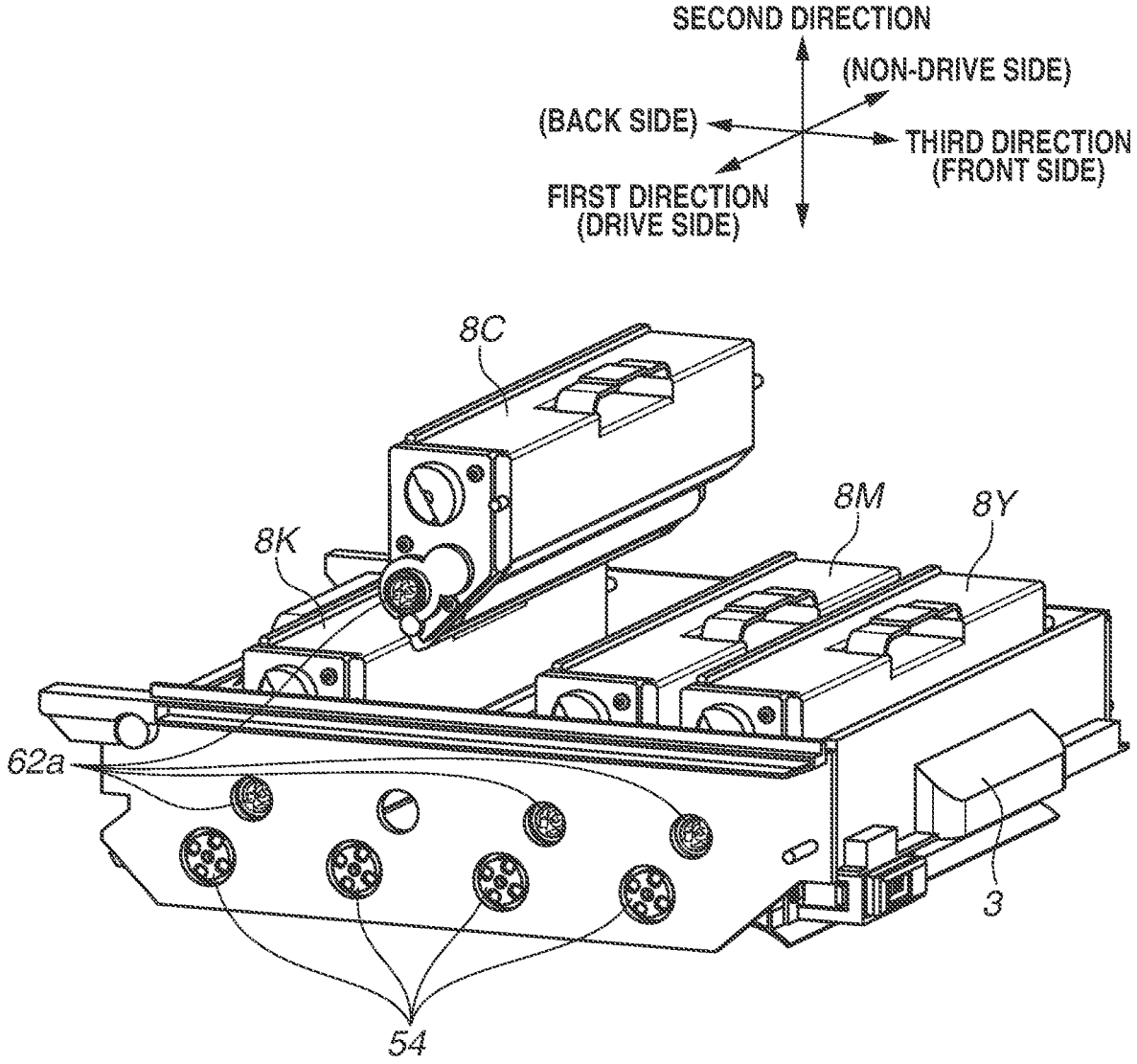
FIG. 4 is a perspective view illustrating a cartridge tray and developing cartridges according to the first exemplary embodiment.
Figure 5:
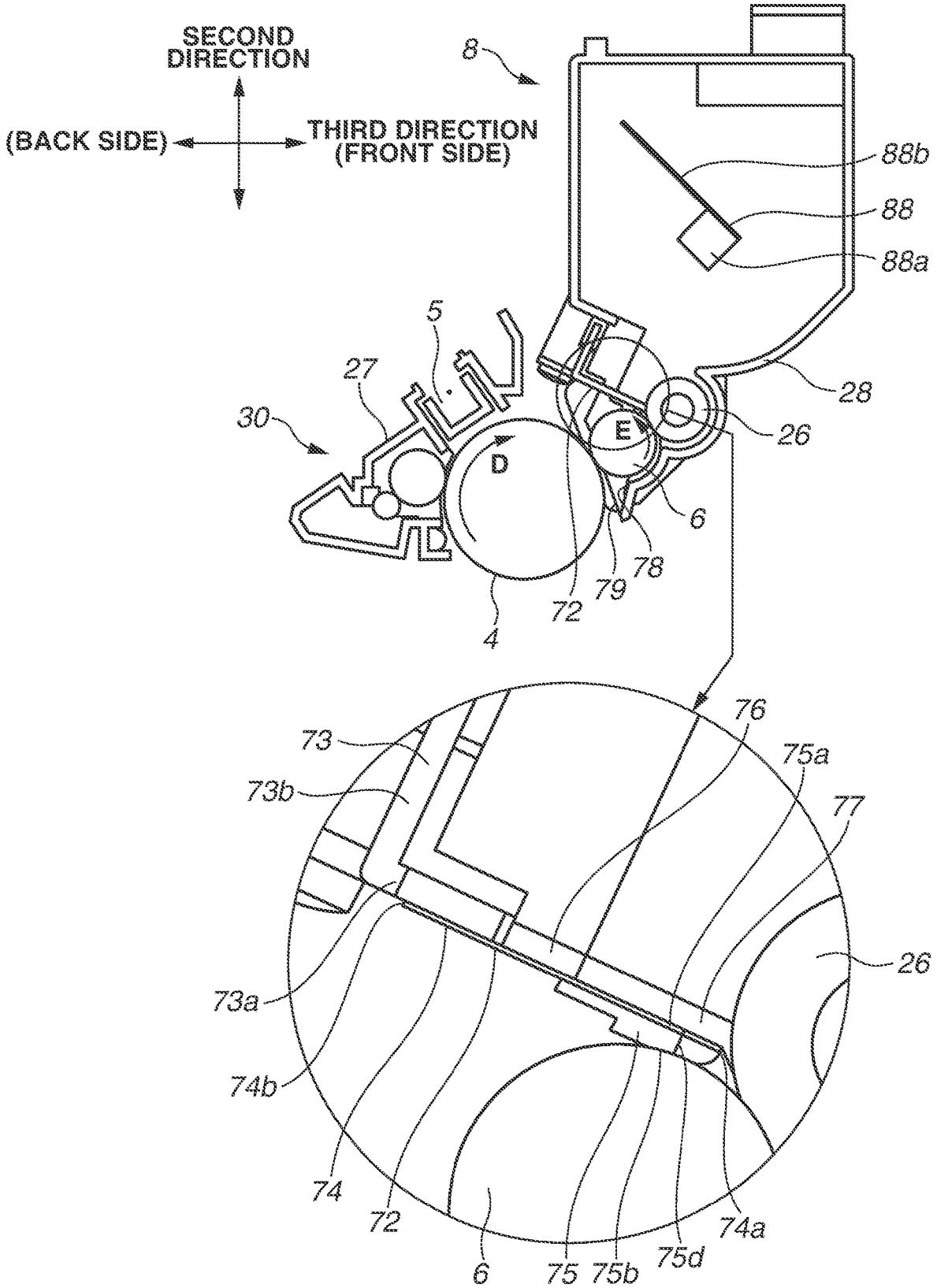
FIG. 5 is a cross sectional view illustrating the developing cartridge and a drum unit according to the first exemplary embodiment.

First, a configuration of an image forming apparatus will be described. FIG. 2 is a cross sectional view illustrating an image forming apparatus 1 according to the first exemplary embodiment. FIGS. 3A and 3B are perspective views each illustrating the image forming apparatus 1 according to the present exemplary embodiment. FIG. 3A illustrates a state where a front door 40 of the image forming apparatus 1 is opened and a cartridge tray 3 is pulled out. In FIG. 3B, the cartridge tray 3 is not illustrated. FIG. 4 is a perspective view illustrating the cartridge tray 3 and developing cartridges 8, which are developing apparatuses, according to the present exemplary embodiment. FIG. 5 is a cross sectional view illustrating the developing cartridge 8 and a drum unit 30 according to the present exemplary embodiment.

Each of FIGS. 2 and 5 is a cross sectional view along a direction vertical to the rotational axis direction of a developing roller 6 as a developing member.

The image forming apparatus 1 illustrated in FIG. 2 is a color laser printer using an electrophotographic image forming process. The image forming apparatus 1 forms a color image on a recording medium S (e.g., printing paper) using developers (e.g., toner) supplied from the developing cartridges 8 (8Y, 8M, 8C, 8K) serving as developing apparatuses. In the present exemplary embodiment, an example in which a color image is formed using four photosensitive drums 4 (4Y, 4M, 4C, 4K) and the four developing cartridges 8 (8Y, 8M, 8C, 8K) is described. The four developing cartridges 8 accommodate developers of different colors (e.g., yellow, cyan, magenta, black). The number of developing cartridges 8 and the number of photosensitive drums 4 can be one to three or five or more depending on the number of colors to be used. In the present exemplary embodiment, structures and operations of the photosensitive drums 4 (4Y, 4M, 4C, 4K) are substantially the same as each other, and structures and operations of the developing cartridges 8 (8Y, 8M, 8C, 8K) are substantially the same as each other, except that the colors of formed images are different from each other. Thus, hereinafter, unless differentiation is necessary, the letters "Y", "M", "C", and "K" will be omitted, and the photosensitive drums 4 (4Y, 4M, 4C, 4K) and the developing cartridges 8 (8Y, 8M, 8C, 8K) will collectively be described. In the present exemplary embodiment, the image forming apparatus 1 includes the four photosensitive drums 4 serving as a plurality of image bearing members and the four developing cartridges 8, which are arranged side by side in the direction intersecting with the vertical direction.

The image forming apparatus 1 includes an image forming apparatus body 2 (hereinafter referred to as an "apparatus body 2") and the photosensitive drums 4. The cartridge tray 3 is attachable to and detachable from the apparatus body 2, and the developing cartridges 8 are attachable to and detachable from the cartridge tray 3.

The apparatus body 2 includes an exposure apparatus 10, an electrostatic transfer apparatus 11, a sheet feeding unit 18, a fixing apparatus 21, a discharge unit 22, and the front door 40.

The exposure apparatus 10 is provided above the developing cartridges 8 and the cartridge tray 3, and outputs laser light L corresponding to image information. With the laser light L, the exposure apparatus 10 exposes and scans surfaces of the photosensitive drums 4 (4Y, 4M, 4C, 4K).

The developing cartridges 8 are provided as developing apparatuses for supplying the developers to the exposed and scanned surfaces of the photosensitive drums 4. A developing process of forming developer images on the surfaces of the photosensitive drums 4 will be described below.

The electrostatic transfer apparatus 11 is provided under the developing cartridges 8 and the cartridge tray 3, and includes a transfer belt 12. The transfer belt 12 faces all the photosensitive drums 4 and circulates so as to come into contact with the photosensitive drums 4. The transfer belt 12 uses a resin film or a multi-layer film-shaped member having a resin layer on a rubber base layer. The transfer belt 12 is stretched by a driving roller 13 and a driven roller 14. Furthermore, the transfer belt 12 electrostatically attracts the recording medium S to an upper outer periphery (in FIG. 2) of the transfer belt 12 and circulates so as to bring the recording medium S into contact with the photosensitive drums 4. In this way, the recording medium S is conveyed to the photosensitive drums 4. Transfer rollers 16 are arranged to be in contact with an inner side of the transfer belt 12 and to face the photosensitive drums 4. During transfer, a predetermined bias is applied to the transfer rollers 16 and an electric charge is applied to the recording medium S via the transfer belt 12. An electric field generated at this time causes the developer images on the photosensitive drums 4 to be transferred onto the recording medium S being in contact with the photosensitive drums 4.

The sheet feeding unit 18 is provided below the electrostatic transfer apparatus 11. The sheet feeding unit 18 includes a sheet feeding tray 19 and a sheet feeding roller 20. The recording medium S is stacked and stored in the sheet feeding tray 19.

The fixing apparatus 21 and the discharge unit 22 are provided at an upper portion of the apparatus body 2. The fixing apparatus 21 fixes the transferred developer images on the recording medium S by heating and pressing. The discharge unit 22 discharges the recording medium S having passed through the fixing apparatus 21 to a discharge tray 23.

The cartridge tray 3 includes the drum units 30 (30Y, 30M, 30C, 30K) including the photosensitive drums 4 that respectively correspond to the four developing cartridges 8 (8Y, 8M, 8C, 8K).

Furthermore, as illustrated in FIGS. 3A and 3B, the cartridge tray 3 can be pulled toward the front side in the third direction, along a tray pull-out rail 41 of the image forming apparatus 1 after the front door 40 of the image forming apparatus 1 is opened.

Each of the developing cartridges 8 includes a developing frame 28 and the developing roller 6 as illustrated in FIG. 5. The developing frame 28 accommodates the developer. The developing roller 6 bears a developer on the surface thereof and is rotatable about a rotation shaft extending in the first direction. The developing cartridge 8 further includes a feeding roller 26 and a layer thickness regulation blade 72. The feeding roller 26 feeds the developer to the developing roller 6. The layer thickness regulation blade 72 is brought into contact with the surface of the developing roller 6 to regulate the layer thickness of the developer borne on the surface of the developing roller 6.

Furthermore, as illustrated in FIG. 4, the developing cartridges 8 are attachable to and detachable from the cartridge tray 3 in the second direction. FIG. 4 illustrates a state where the developing cartridge 8C is removed from the cartridge tray 3 as an example. As illustrated in the FIG. 4, the developing cartridges 8 can be inserted into and removed from four slots of the cartridge tray 3, so that the developing cartridges 8 can be replaced depending on usage conditions.

<<Image Forming Process>>>

Next, an image forming process will be described with reference to FIGS. 2 and 5.

During execution of the image forming process, the photosensitive drums 4 are driven and rotated at a predetermined speed in a direction indicated by an arrow D. The transfer belt 12 of the electrostatic transfer apparatus 11 is also driven and rotated at a speed corresponding to the speed of the photosensitive drums 4 in a direction indicated by an arrow C. First, the charging apparatuses 5 uniformly charge the surfaces of the photosensitive drums 4 to a predetermined polarity and a predetermined electric potential. Thereafter, the exposure apparatus 10 outputs the laser light L corresponding to image signals of the respective colors, and exposes and scans the surfaces of the photosensitive drums 4. In this way, electrostatic latent images corresponding to the image signals of the respective colors are formed on the surfaces of the photosensitive drums 4.

The developer in the developing frame 28 is borne by the developing roller 6 driven and rotated at a predetermined speed in a direction indicated by an arrow E. The developer to be borne by the developing roller 6 is fed to the surface of the developing roller 6 by the feeding roller 26. The developer fed to the developing roller 6 then enters between the developing roller 6 and the layer thickness regulation blade 72, and a thin layer of the developer with a predetermined thickness is borne on the developing roller 6. The developer borne on the developing roller 6 is fed to the electrostatic latent image formed on the photosensitive drum 4. This causes the developer to adhere to the electrostatic latent image to develop (visualize) the electrostatic latent image, so that a developer image is formed on the surface of the photosensitive drum 4. In the present exemplary embodiment, the developer has positive polarity. Thus, a voltage of positive polarity is applied to the developing roller 6 from a developing power source (not illustrated), compared to an electric potential of the electrostatic latent image formed on the surface of the photosensitive drum 4. With the above-described setting, the developer charged to positive polarity is moved from the developing roller 6 to the electrostatic latent image formed on the photosensitive drum 4.

Sheets of the recording medium S are separated and fed one by one at a predetermined control timing. The recording medium S is moved to a transfer portion where a leading edge of the developer image on the surface of the photosensitive drum 4Y, which is the first photosensitive drum, faces the transfer belt 12. The recording medium S is conveyed to the transfer portion at a predetermined control timing in synchronization with the rotation of the photosensitive drums 4 so that print start positions match at the transfer portion. By an electric field generated between the photosensitive drums 4 and the transfer rollers 16, the developer images on the photosensitive drums 4 are sequentially transferred onto the recording medium S that is electrostatically attracted and conveyed by the transfer belt 12. At this time, a voltage of negative polarity, which is opposite to the positive polarity, is applied to the transfer rollers 16 from a transfer power source (not illustrated). This allows the developers of positive polarity to be electrically attracted toward the recording medium S.

The recording medium S on which the developer images of the four colors are transferred is separated from the transfer belt 12 and conveyed to the fixing apparatus 21. The developer images are thermally fixed to the recording medium S by the fixing apparatus 21. Thereafter, the recording medium S is discharged to the discharge tray 23 by the discharge unit 22.

Furthermore, the untransferred developers remaining on the photosensitive drums 4 are collected for reuse by the developing cartridges 8. More specifically, the charging apparatuses 5 charge the photosensitive drums 4 to positive polarity once so that the electric potentials of the surfaces of the photosensitive drums 4 are higher toward the positive polarity side than the voltage applied to the developing rollers 6. As a result, the residual developers charged to positive polarity on the surfaces of the photosensitive drums 4 are moved to portions where the photosensitive drums 4 face the developing rollers 6, and the residual developers are electrically collected into the developing frames 28.

<<Detailed Configuration of Drum Unit and Development Cartridge>>

Figure 6:
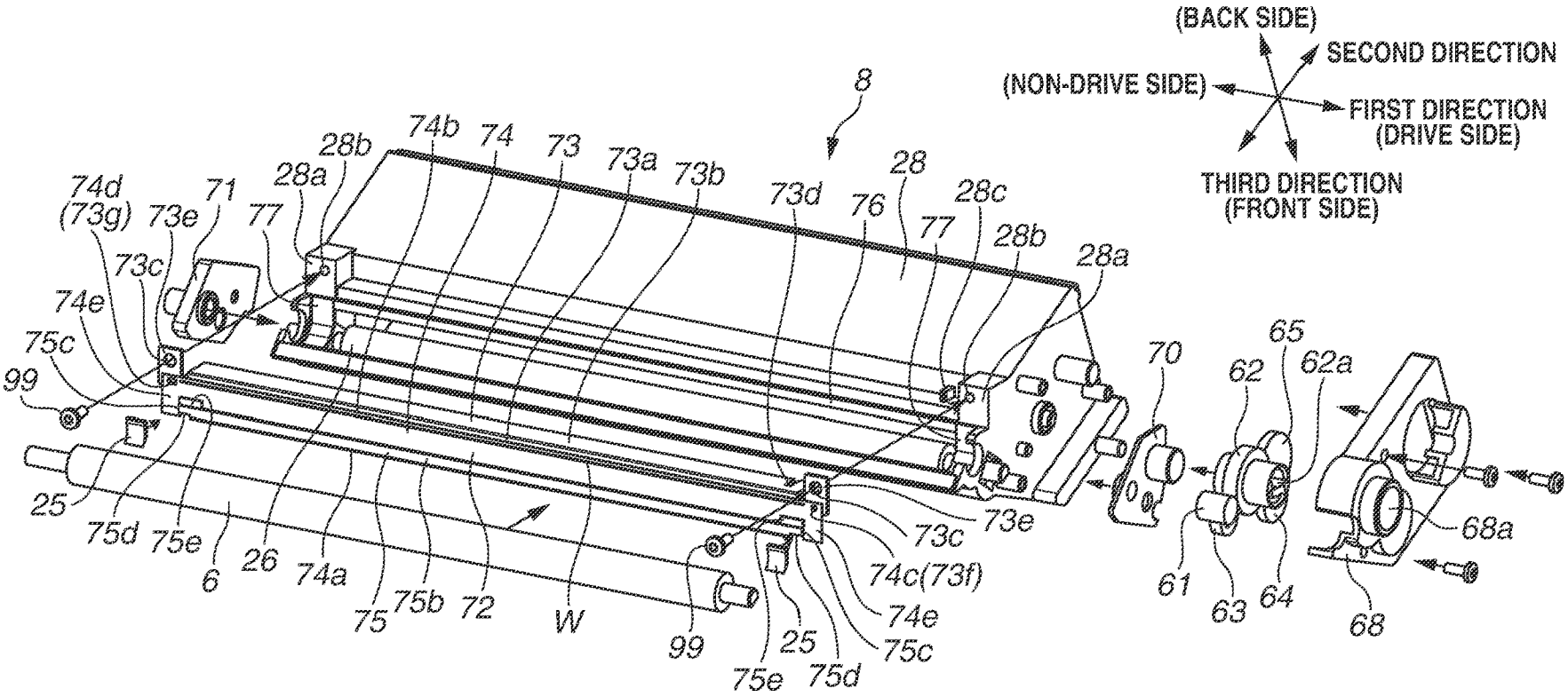
FIG. 6 is an exploded perspective view illustrating the developing cartridge according to the first exemplary embodiment.

Next, a detailed configuration of the drum unit 30 and the developing cartridge 8 will be described with reference to FIGS. 5 and 6. FIG. 6 is an exploded perspective view illustrating the developing cartridge 8 according to the present exemplary embodiment. In FIG. 6, attachment directions of components are indicated by arrows.

As illustrated in FIG. 5, the drum unit 30 includes the photosensitive drum 4, the drum frame 27, and the charging apparatus 5 as described above. The photosensitive drum 4 is attached to the drum frame 27 and is rotatable about a rotation shaft extending in the first direction. In addition, a drum input coupling 54 (refer to FIG. 4) that transmits a driving force to the corresponding photosensitive drum 4 is provided on the drive side of the photosensitive drum 4. The drum input coupling 54 is engaged with a drum driving coupling 52 (refer to FIG. 3B) of the apparatus body 2 to receive a driving force from the apparatus body 2 and transmit the driving force to the photosensitive drum 4. The charging apparatus 5 is provided along the first direction and supported by the drum frame 27 near the photosensitive drum 4. The charging apparatus 5 is electrically connected to the apparatus body 2.

As described above, each of the developing cartridges 8 includes the developing frame 28, the developing roller 6, the feeding roller 26, and the layer thickness regulation blade 72. The developing frame 28 accommodates the developer. The feeding roller 26 feeds the developer to the developing roller 6. The layer thickness regulation blade 72 regulates the thickness of the developer borne on the surface of the developing roller 6. As illustrated in FIG. 6, the developing cartridge 8 further includes fixing screws 99, a stirring member 88 (refer to FIG. 5), a drive-side bearing member 70, a side cover 68, and a non-drive-side bearing member 71. The developing cartridge 8 further includes a developing gear 61, a feeding gear 63, a developing input gear 62, a stirring gear 65, and an idler gear 64. The developing gear 61 drives the members of the developing cartridge 8. Details thereof will be described below.

As illustrated in FIG. 5, the developing roller 6 is rotatable about the rotation shaft extending in the first direction, in the direction indicated by the arrow E. The developing roller 6 includes a roller body and a roller shaft. Examples of materials of the roller body are elastic rubbers and sponge members. In addition, conductive metals or resins are used as materials of the roller shaft. Furthermore, the developing gear 61 is coupled to a drive-side end portion of the roller shaft. The feeding roller 26 is brought into contact with the developing roller 6 to feed the developer to the surface of the developing roller 6. The feeding roller 26 is rotatable about a rotation shaft extending in the first direction. The feeding roller 26 includes a roller body and a roller shaft. Examples of materials of the roller body are elastic rubbers and sponge members. In addition, conductive metals or resins are used as materials of the roller shaft. Furthermore, the feeding gear 63 is coupled to a drive-side end portion of the roller shaft.

Next, a configuration of the layer thickness regulation blade 72 will be described with reference to FIG. 6. The layer thickness regulation blade 72 is brought into contact with the developing roller 6 and regulates the thickness of the developer borne on the surface of the developing roller 6. The layer thickness regulation blade 72 includes a support plate 73, a blade portion 74, and a regulation portion 75.

The support plate 73 is a metal member that supports the blade portion 74. The support plate 73 includes a first plate-shaped portion 73*a* and a second plate-shaped portion 73*b*. The first plate-shaped portion 73*a* has a substantially rectangular shape extending in the first direction and facing the blade portion 74. The second plate-shaped portion 73*b* extends from the first plate-shaped portion 73*a* in a direction intersecting with the blade portion 74. The first plate-shaped portion 73*a* includes protrusions 73*e* at the respective ends thereof in the first direction. Each of the protrusions 73*e* protrudes in a direction away from the developing roller 6 in a direction perpendicular to the first direction. Each of the protrusions 73*e* includes a through hole 73*c* in a thickness direction. The second plate-shaped portion 73*b* includes a positioning groove 73*d* having a narrow groove shape.

The blade portion 74 is a metal plate-like member that has a substantially rectangular shape extending in the first direction. The blade portion 74 is disposed so that a leading edge portion 74*a* of blade portion 74, which is an end portion in the direction intersecting with the first direction, faces the developing roller 6. In addition, a base end portion 74*b* of blade portion 74, which is the other end portion in the direction intersecting with the first direction, is fixed by welding to the first plate-shaped portion 73*a* of the support plate 73 and forms a fixed portion W, which is a welding mark. Each end portion of the blade portion 74 in the first direction includes a blade end portion 74*e*. The thickness of the blade portion 74 is set to be thinner than the support plate 73 so that the blade portion 74 can be elastically deformed when the blade portion 74 is brought into contact with the developing roller 6. The blade portion 74 is brought into contact with the developing roller 6 by a restorative force generated during the elastic deformation, and regulates the thickness of the developer borne on the surface of the developing roller 6.

Furthermore, one end portion of the blade portion 74 in the first direction includes a circular hole 74*c* and the other end portion includes a long hole 74*d*. The first plate-shaped portion 73*a* of the support plate 73 includes a circular hole 73*f* and a long hole 73*g* at positions corresponding to the circular hole 74*c* and the long hole 74*d*, respectively. In fixing the blade portion 74 to the support plate 73, assembly jigs are passed through the circular holes 74*c* and 73*f* and the long holes 74*d* and 73*g* to perform positioning between the blade portion 74 and the support plate 73, and then the blade portion 74 is fixed to the support plate 73. This increases the positioning accuracy of the relative position of the support plate 73 and the blade portion 74. In the present exemplary embodiment, each of the support plate 73 and the blade portion 74 includes hole shapes. Alternatively, one of the support plate 73 and the blade portion 74 may have hole shapes and the other may have protrusion shapes, and the relative position between the support plate 73 and the blade portion 74 may be regulated by engaging the holes and the protrusions.

The regulation portion 75 is a regulation member that has a substantially rectangular shape extending in the first direction and is formed inside the blade end portions 74*e* of the blade portion 74 in the first direction. The regulation portion 75 is a flexible regulation member made of a rubber member, such as a silicon rubber or urethane rubber, or a resin material. The regulation portion 75 includes a first surface 75*a* (refer to FIG. 5) and a second surface 75*b*. The first surface 75*a* faces the blade portion 74 and is fixed to the leading edge portion 74*a*. The second surface 75*b* faces the developing roller 6 and is brought into contact with the surface of the developing roller 6. A cross-sectional shape of a corner portion of the second surface 75*b* on a leading edge side of the layer thickness regulation blade 72 is arc-shaped when viewed from the first direction (refer to FIG. 5). In addition, each end portion of the regulation portion 75 in the first direction includes a notch portion 75*d*. The notch portion 75*d* has a shape that is depressed toward the base end portion 74*b* from a leading edge side end portion of the layer thickness regulation blade 72 and is also depressed inward in the first direction from an end portion 75*c* of the regulation portion 75 in the first direction. A cross-sectional shape of a portion having the notch portion 75*d*, which is in the corner portion of the regulation portion 75 on the leading edge side of the layer thickness regulation blade 72, is substantially right-angled when viewed from the first direction. The developing roller 6 is rotated in the direction indicated by the arrow E (refer to FIG. 5) while rubbing the regulation portion 75. Thus, the developer on the developing roller 6 can be scraped more easily at the portion having the notch portion 75*d* than at the inner portion in the first direction where the notch portion 75*d* is not formed in the corner portion of the regulation portion 75 on the leading edge side of the layer thickness regulation blade 72. More specifically, as illustrated in FIG. 5, a contact width between the developing roller 6 and the regulation portion 75 in the rotation direction of the developing roller 6 is wide at the portion where the notch portion 75*d* is not formed. On the other hand, the contact width is narrow at the portion having the notch portion 75*d*, so that the contact pressure is high and the developer on the developing roller 6 can be scraped easily. In addition, at the portion where the notch portion 75*d* is not formed, the leading edge corner portion of the regulation portion 75 has an arc shape, so that the developer is more likely to be guided toward the surface of the developing roller 6. On the contrary, at the portion having the notch portion 75*d*, the leading edge corner portion of the regulation portion 75 is substantially right-angled, so that the developer is less likely to be guided toward the surface of the developing roller 6 and is more likely to be scraped.

Each end portion of the regulation portion 75 in the first direction includes a protrusion 75*e*. The protrusion 75*e* protrudes from the other portions in the direction away from the developing roller 6 in the direction perpendicular to the first direction. The protrusion 75*e* is thinner than the other portions of the regulation portion 75 and is closer to the blade portion 74 than the second surface 75*b*. The leading edge portion 74*a* of the blade portion 74 has a shape corresponding to the regulation portion 75 and the notch portion 75*d*.

The developing frame 28 accommodates the developer therein and includes a blade support surface 28*a* and a fixing hole 28*b* provided in the blade support surface 28*a*. The blade support surface 28*a* faces the support plate 73 of the layer thickness regulation blade 72. In addition, the developing frame 28 includes a positioning rib 28*c* at a position corresponding to the positioning groove 73*d* of the support plate 73 of the layer thickness regulation blade 72, and rotatably supports the stirring gear 65 and one end of the idler gear 64. In a state where the blade support surface 28*a* and the support plate 73 are abutted against each other and the positioning rib 28*c* and the positioning groove 73*d* are engaged with each other, the fixing screws 99 passed through the through holes 73*c* are screwed into the fastening holes 28*b*, so that both end portions of the developing frame 28 and the layer thickness regulation blade 72 are fixed to each other. As illustrated in FIG. 5, the stirring member 88 is provided inside the developing frame 28 and includes a shaft portion 88*a* and a sheet portion 88*b*. The shaft portion 88*a* is rotatable about a rotation shaft extending in the first direction. The sheet portion 88*b* is in the form of a flexible sheet. The stirring member 88 stirs the developer in the developing frame 28 and conveys the developer toward the feeding roller 26. In addition, as illustrated in FIG. 6, the stirring gear 65 is connected to a drive-side end portion of the shaft portion 88*a*. The drive-side bearing member 70 is fixed to the developing frame 28 at the drive side, and rotatably supports the roller shaft of the developing roller 6, the roller shaft of the feeding roller 26, and the developing input gear 62. The side cover 68 is fixed to the developing frame 28 at the drive side. The side cover 68 rotatably supports the other end of the idler gear 64 and has a function of covering and protecting the feeding gear 63, the developing input gear 62, the idler gear 64, and the stirring gear 65. The side cover 68 has a through hole 68*a* at a position corresponding to the developing input gear 62, and the through hole 68*a* exposes a coupling portion 62*a* of the developing input gear 62, which will be described below. The non-drive side bearing member 71 is fixed to the developing frame 28 at the non-drive side, and rotatably supports the roller shaft of the developing roller 6 and the roller shaft of the feeding roller 26. The developing input gear 62 includes the coupling portion 62*a* that is engaged with a developing driving coupling 51 (refer to FIG. 3B) of the apparatus body 2 to receive a driving force. The driving force input to the developing input gear 62 is transmitted to the developing roller 6 via the developing gear 61 and to the feeding roller 26 via the feeding gear 63. Similarly, the driving force input to the developing input gear 62 is transmitted to the stirring member 88 via the idler gear 64 and the stirring gear 65.

<<Developer Sealing Configuration of Development Cartridge>>

Figure 1:
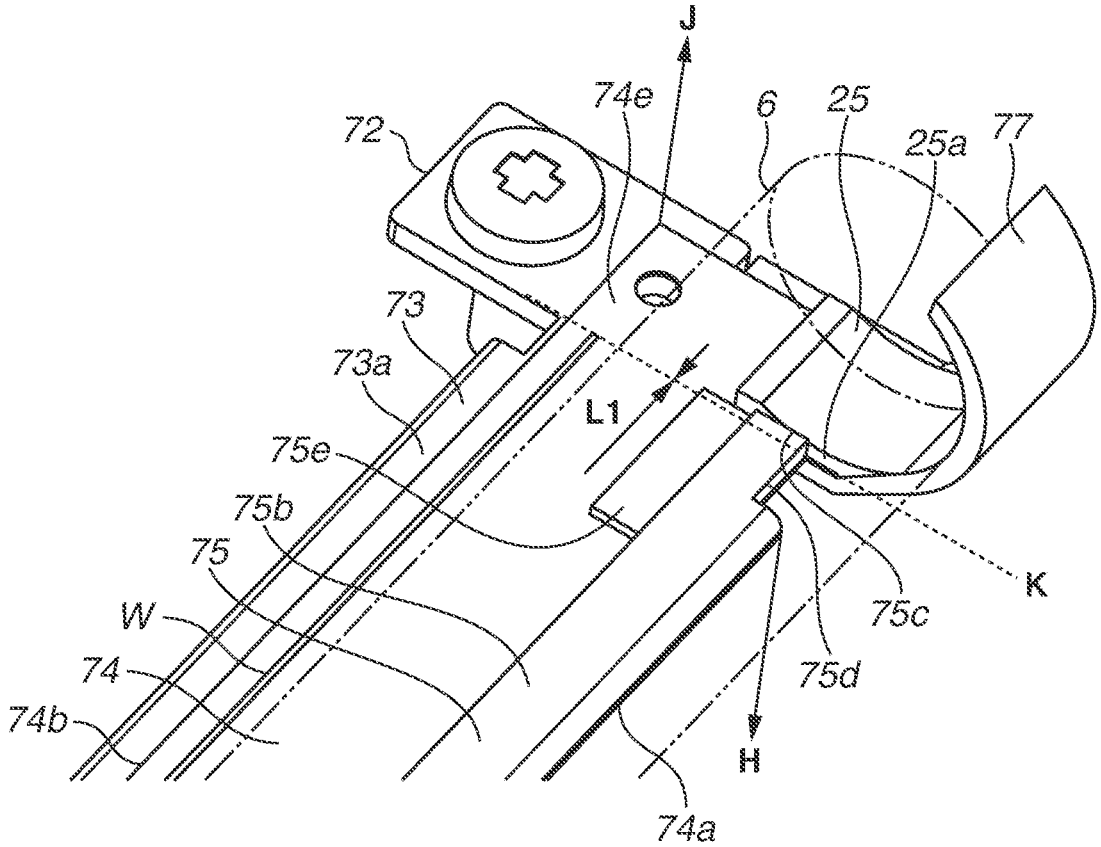
FIG. 1 is a perspective view illustrating a regulation blade according to a first exemplary embodiment.
Figure 7A:
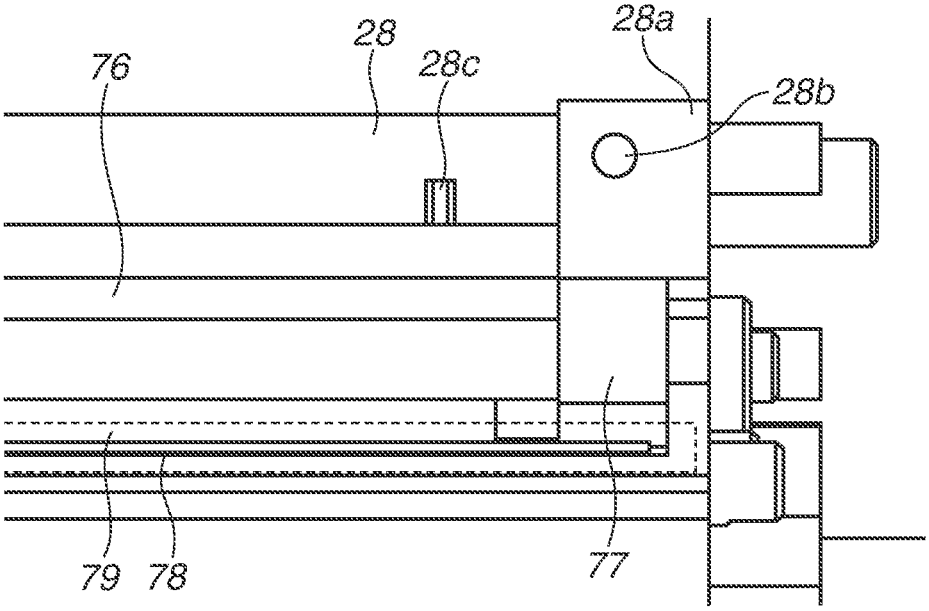
FIGS. 7A and 7B are diagrams each illustrating the developing cartridge according to the first exemplary embodiment.
Figure 7B:
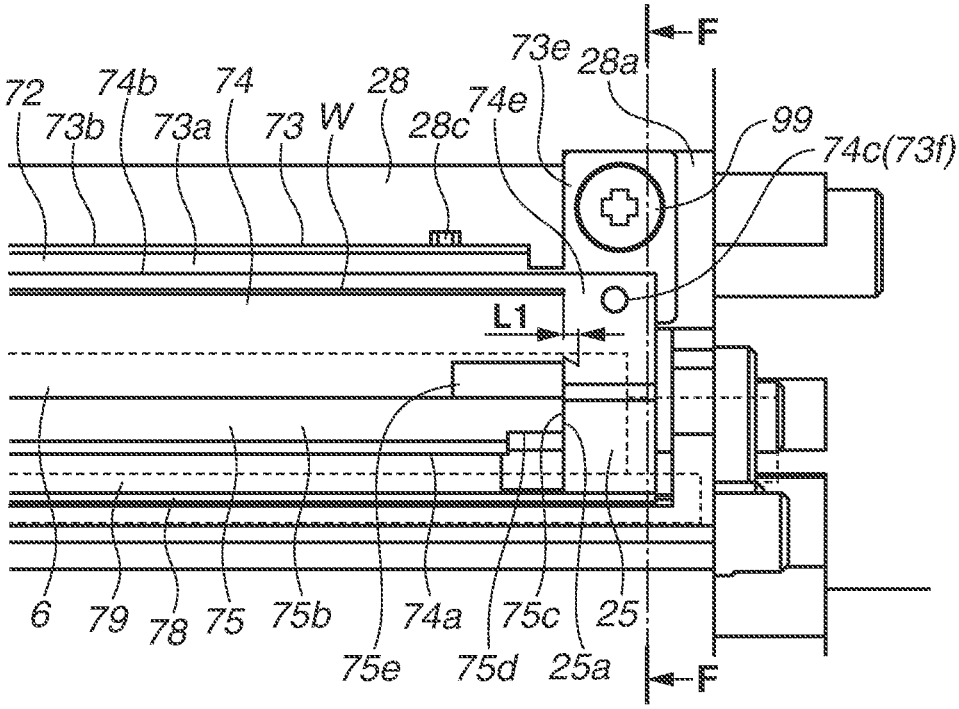
Figure 8:
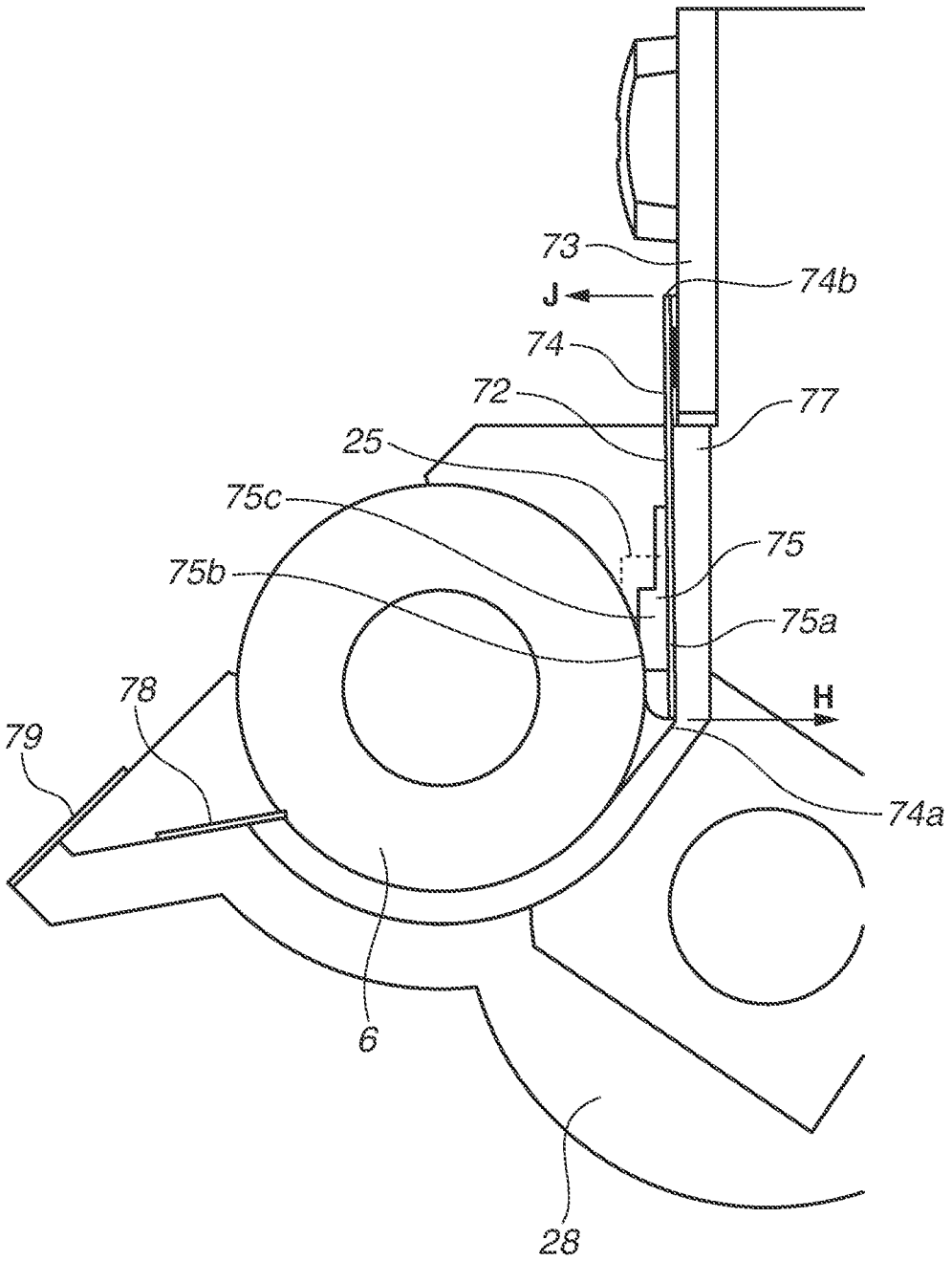
FIG. 8 is a cross sectional view illustrating the developing cartridge according to the first exemplary embodiment.
Figure 9A:
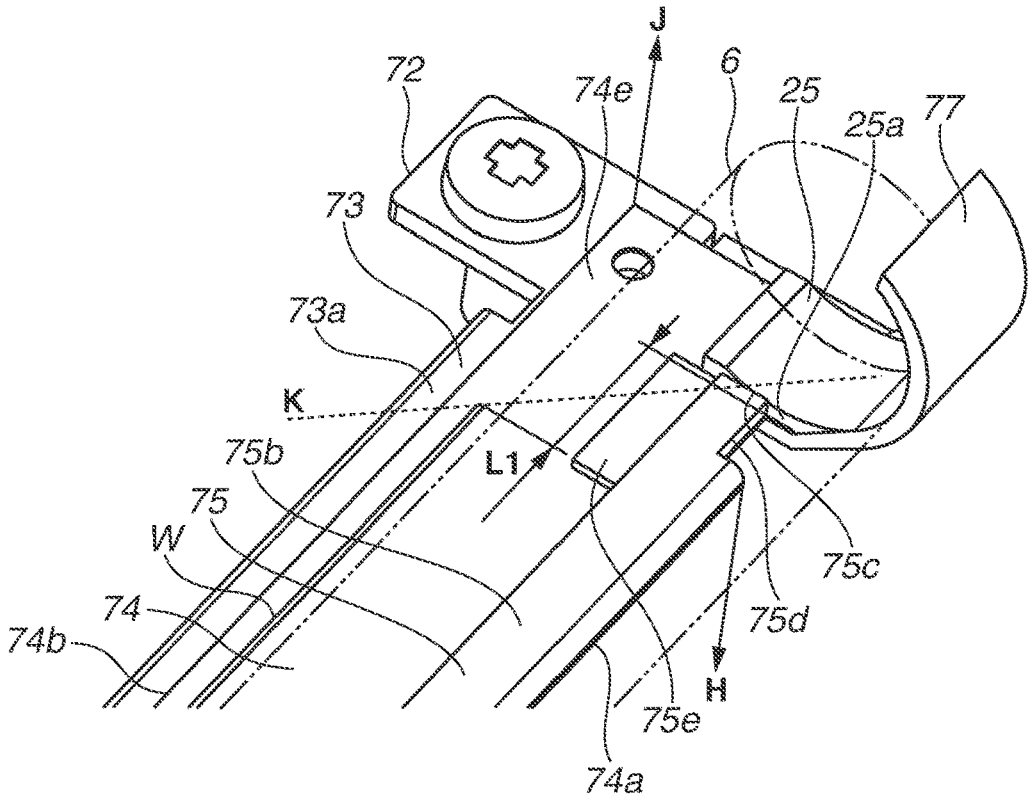
FIGS. 9A and 9B are perspective views each illustrating the regulation blade according to the first exemplary embodiment.
Figure 9B:
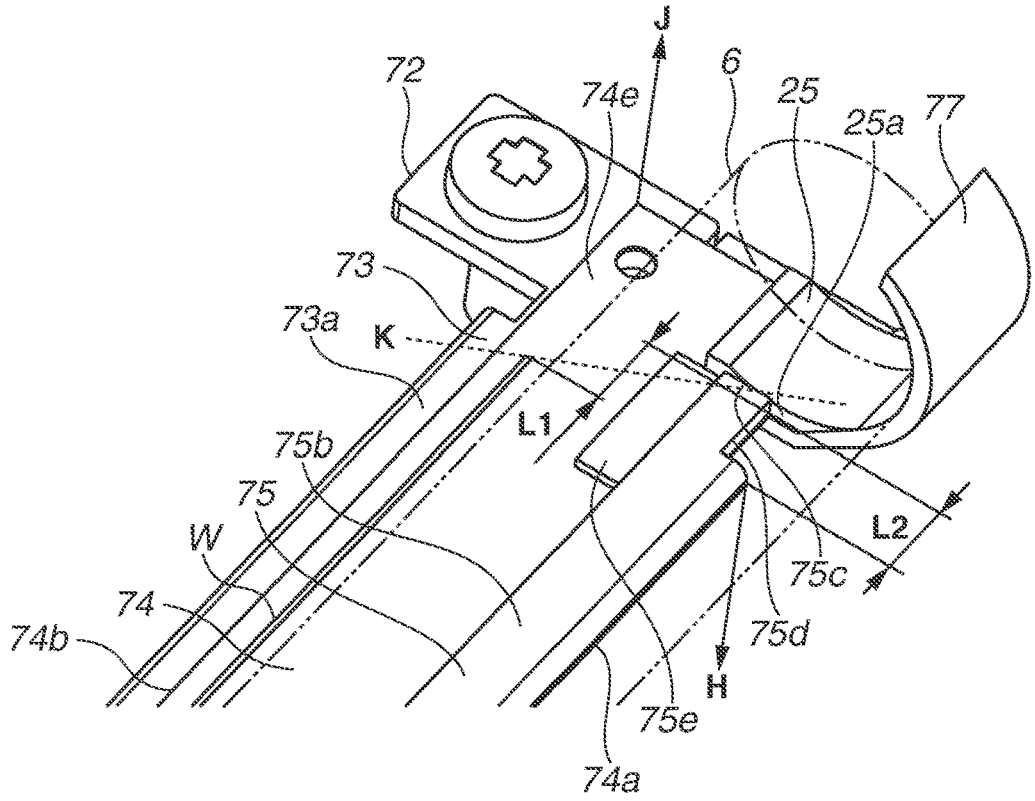
Figure 10A:
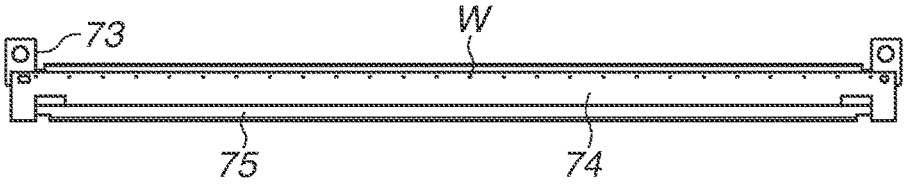
FIGS. 10A to 10G are diagrams each illustrating the regulation blade according to the first exemplary embodiment.
Figure 10B:
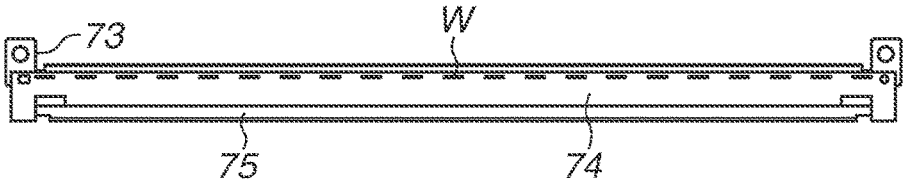
Figure 10C:
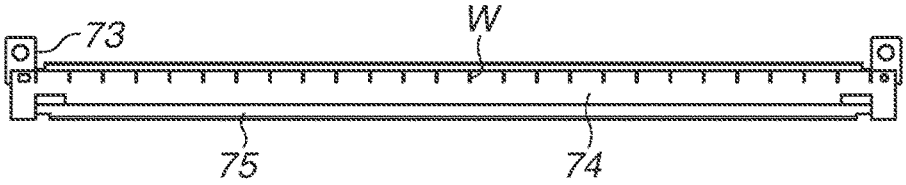
Figure 10D:
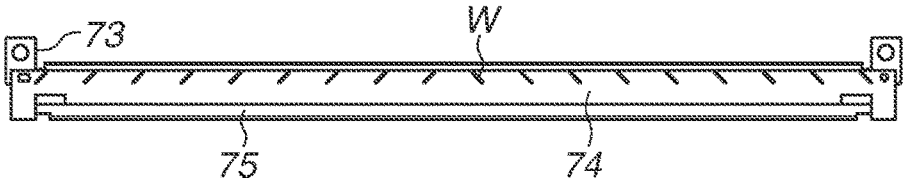
Figure 10E:
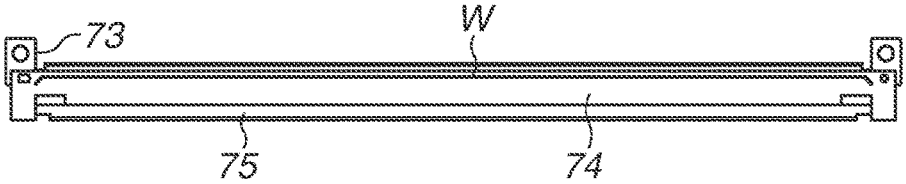
Figure 10F:
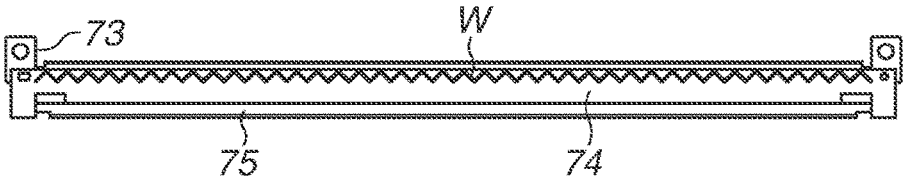
Figure 10G:
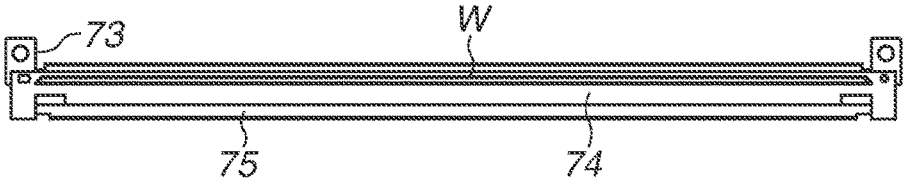

Next, a developer sealing configuration of the developing cartridge 8 will be described with reference to FIGS. 1, 7A, 7B, 8, 9A, 9B, and 10A to 10G. FIG. 1 is a perspective view illustrating the layer thickness regulation blade 72 according to the present exemplary embodiment. FIGS. 7A and 7B each illustrate the developing cartridge 8 according to the present exemplary embodiment that is viewed from an attachment direction of the layer thickness regulation blade 72. In FIG. 7A, the developing roller 6 and the layer thickness regulation blade 72 are not illustrated, and an anti-scattering sheet 79 is indicated by a broken line. In FIG. 7B, each of the developing roller 6 and the anti-scattering sheet 79 is indicated by a broken line. FIG. 8 is a cross sectional view illustrating the developing cartridge 8 according to the present exemplary embodiment that is viewed from the rotational axis direction of the developing roller 6 along a section line F-F in FIG. 7B. In FIG. 8, an end portion seal member 25 is indicated by a broken line. FIGS. 9A and 9B are perspective views each illustrating the layer thickness regulation blade 72 according to the present exemplary embodiment. FIGS. 10A to 10G each illustrate the layer thickness regulation blade 72 according to the present exemplary embodiment that is viewed from a thickness direction of the blade portion 74 of the layer thickness regulation blade 72.

While the drive side is described below as an example, the same applies to the non-drive side.

As illustrated in FIG. 7A, a first seal member 76 is provided between the layer thickness regulation blade 72 and the developing frame 28 along the rotational axis direction (first direction) of the developing roller 6. In addition, a second seal member 77 is provided between each end portion of the layer thickness regulation blade 72 in the first direction and the developing frame 28. The first seal member 76 and the second seal member 77 include a flexible member such as sponge and are compressed between the developing frame 28 and the layer thickness regulation blade 72 to fill a gap between the developing frame 28 and the layer thickness regulation blade 72, so that the developer is prevented from leaking.

Further, as illustrated in FIG. 7B, the end portion seal member 25 is fixed to the blade end portion 74*e* of the blade portion 74. The end portion seal member 25 is in contact with the end portion 75*c*, which is an end surface of the regulation portion 75. The end portion 75*c* is the outermost portion, in the first direction, of the second surface 75*b* that is brought into contact with the developing roller 6, and is in contact (tight contact) with an end portion 25*a*, which is an inner end surface of the end portion seal member 25. Furthermore, at least a portion of the end portion seal member 25 extends from the blade end portion 74*e* of the blade portion 74 in the direction of the leading edge portion 74*a* and is fixed to a surface of the second seal member 77 that faces the developing roller 6 (refer to FIG. 8). The end portion seal member 25 is disposed between the blade portion 74 and the developing roller 6 in the thickness direction of the blade portion 74 that intersects with the first direction.

The end portion seal member 25 includes a flexible member such as sponge and is disposed and compressed between the blade portion 74 and the developing roller 6 to prevent the developer from leaking from between the end portion seal member 25 and the regulation portion 75. In addition, the second seal member 77 and the end portion seal member 25 are compressed at both end portions of the developing roller 6 in the first direction to fill a gap among the developing frame 28, the layer thickness regulation blade 72, and the developing roller 6, so that the developer is prevented from leaking.

Furthermore, a third seal member 78 is provided in the developing frame 28 along the first direction. The third seal member 78 is a flexible sheet-shaped member made of a material such as polyethylene terephthalate (PET), polyphenylene sulfide (PPS), or polycarbonate (PC). One end of the third seal member 78 in the direction perpendicular to the first direction is attached to the developing frame 28, and the other end is in contact with the developing roller 6. The third seal member 78 is deformed to fill a gap between the developing frame 28 and the developing roller 6, so that the developer is prevented from leaking.

Furthermore, the anti-scattering sheet 79 is provided along the first direction near the third seal member 78. One end of the anti-scattering sheet 79 in the direction perpendicular to the first direction is attached to the developing frame 28, and the other end extends toward the developing roller 6 (refer to FIG. 8). The anti-scattering sheet 79 has a function of receiving the developer dropping from the vicinity of the developing roller 6 to prevent the developer from scattering to the outside.

The fixed portion W where the support plate 73 and the blade portion 74 are fixed by welding is formed inside the end portion 75*c* in the first direction and is not formed outside the end portion 75*c* in the first direction. The fixed portion W is formed continuously along the first direction. In the present exemplary embodiment, as illustrated in FIG. 7B, a distance L1 between the fixed portion W and the end portion 75*c* in the first direction is set to 0 mm. In other words, the support plate 73 and the blade portion 74 are not fixed at an area where the blade portion 74 and the end portion seal member 25 overlap in the first direction. Details thereof will be described below.

In the present exemplary embodiment, the terms "inside", "outside" are defined as follows. The term "inside" refers to a side that is closer to the centers of the developing roller 6 and the layer thickness regulation blade 72 in the rotational axis direction of the developing roller 6. The term "outside" refers to a side that is farther from the centers of the developing roller 6 and the layer thickness regulation blade 72. Hereinafter, unless otherwise specified, the foregoing definitions apply.

As illustrated in FIG. 8, when the layer thickness regulation blade 72 is brought into contact with the developing roller 6, the leading edge portion 74*a* receives a force via the regulation portion 75, and the blade portion 74 is deformed in a direction indicated by an arrow H. Meanwhile, a restorative force to restore the deformed blade portion 74 to the original shape is applied to the fixed portion W (refer to FIG. 7B) of the base end portion 74*b*. At each end portion in the first direction where the fixed portion W is not formed, the blade portion 74 is deformed in a direction indicated by an arrow J by the restorative force and a repulsion force of the second seal member 77.

The deformation of the blade portion 74 at each end portion in the first direction where the fixed portion W is not formed will be described further with reference to FIG. 1.

The deformation of the blade portion 74 at each end portion in the first direction is a combination of the deformation of the blade end portion 74*e* along a broken line K in the direction indicated by the arrow J and the foregoing deformation in the direction indicated by the arrow H. The broken line K is a line connecting the end portion 75*c* of the regulation portion 75 in contact with the developing roller 6 and an end portion of the fixed portion W.

When the blade portion 74 is deformed as described above, the end portion seal member 25 attached to the blade portion 74 is compressed to further bite into the end portion 75*c* of the regulation portion 75. In other words, adhesion between the end portion 25*a* of the end portion seal member 25 and the end portion 75*c* of the regulation portion 75 is increased in the first direction. This more effectively prevents the developer from leaking from between the end portion seal member 25 and the regulation portion 75. In the present exemplary embodiment, the configuration in which the end portion 25*a*, which is an end surface of the end portion seal member 25, and the end portion 75*c*, which is an end surface of the regulation portion 75, are constantly in contact with each other is employed. Alternatively, the configuration in which the end portion 25*a* (end surface of the end portion seal member 25) and the end portion 75*c* (end surface of the regulation portion 75) can be brought into contact with each other when a force in the direction indicated by the arrow J is increased by action of a force in the direction indicated by the arrow H as a result of attaching the developing roller 6 to the developing cartridge 8 may be used. In other words, the end portion 25*a* (end surface of the end portion seal member 25) and the end portion 75*c* (end surface of the regulation portion 75) do not necessarily have to be in contact with each other in a state where the developing roller 6 is not attached to the developing cartridge 8.

For example, in a case where the fixed portion W of the support plate 73 and the blade portion 74 is formed up to the outside of the end portion 75*c* in the first direction, the deformation of each end of the blade portion 74 in the first direction is regulated by the fixed portion W. Thus, the blade portion 74 is hardly deformed in a direction in which the end portion seal member 25 and the end portion 75*c* of the regulation portion 75 are brought close to each other. Therefore, the above-described action is less likely to occur.

In order to cause the above-described action, it is desirable to greatly deform each end portion of the blade portion 74 in the first direction. Thus, as illustrated in FIG. 9A, the distance L1 between the fixed portion W and the end portion 75*c* in the first direction can be set to be large. With this setting, the blade portion 74 is deformed more greatly than in the case where the distance L1 is set to 0 mm, so that the end portion seal member 25 fixed to the blade portion 74 can be brought into tight contact with the end portion 75*c* of the regulation portion 75.

In addition, as illustrated in FIG. 9B, the distance L1 between the fixed portion W and the end portion 75*c* in the first direction can be set to the same value as a width L2 of the notch portion 75*d* in the first direction. With this setting, the blade portion 74 is deformed more greatly than in the case where the distance L1 is set to 0 mm, so that the end portion seal member 25 fixed to the blade portion 74 can be brought into tighter contact with the end surface of the regulation portion 75.

Furthermore, a reason for employing the configuration illustrated in FIG. 9B is that, in the area where the notch portion 75*d* is not formed in the first direction, it is sometimes desirable to fix the base end portion 74*b* of the blade portion 74 to the support plate 73. In the area where the notch portion 75*d* is not formed, a coating amount of the developer for forming an image needs to be regulated during an image forming operation. If there is a portion where the base end portion 74*b* of the blade portion 74 is not fixed to the support plate 73 in the first direction, the contact force between the layer thickness regulation blade 72 and the developing roller 6 at the portion may decrease, resulting in occurrence of an image defect such as image density unevenness in the first direction. However, with the above-described setting, a decrease in the contact force can be prevented across the entire area where the notch portion 75*d* is not formed in the first direction.

As described above, the distance L1 between the fixed portion W and the end portion 75*c* in the first direction can be set to any amount that is greater than or equal to 0 mm in consideration of the contact state between the end portion seal member 25 and the regulation portion 75 and the contact force between the layer thickness regulation blade 72 and the developing roller 6.

Based on those described above, a configuration for increasing the adhesion between the end portion seal member 25 and the regulation portion 75 in the developing cartridge 8 will be described next. The developing cartridge 8 used in the image forming apparatus 1 includes the developing frame 28 that accommodates the developer, the developing roller 6 that bears the developer and is rotatable, the layer thickness regulation blade 72 that is fixed to the developing frame 28 and regulates the developer borne on the surface of the developing roller 6, and the end portion seal member 25 that prevents the developer from leaking outside the developing frame 28. The layer thickness regulation blade 72 includes the support plate 73 extending in the rotational axis direction of the developing roller 6. The layer thickness regulation blade 72 further includes the blade portion 74 as a plate-shaped member having one end portion, which is the leading edge portion 74*a*, and the other end portion, which is the base end portion 74*b*, in a direction intersecting with the rotational axis direction. The one end portion faces the developing roller 6 and the other end portion is supported by the support plate 73. The regulation portion 75, which is a regulation member, of the layer thickness regulation blade 72 regulates the developer borne on the surface of the developing roller 6, is fixed to a facing surface of the blade portion 74 that faces the development roller 6 at the one end portion, and is in contact with the development roller 6. Furthermore, the regulation portion 75 is formed inside the blade end portions of the blade portion 74 in the rotational axis direction. The end portion seal member 25 is fixed to the facing surface of the blade portion 74, is arranged at the end portions of the blade portion 74 and side by side with the regulation portion 75 in the rotational axis direction, and is in contact with the end portion 75*c* of the regulation portion 75. In addition, the end portion seal member 25 is disposed between the blade portion 74 and the developing roller 6 in the direction intersecting with the rotational axis direction. The blade portion 74 is welded to a region of the support plate 73 excluding a region outside the end portion 75*c* of the regulation portion 75 in the rotational axis direction.

The present disclosure is not limited to the present exemplary embodiment and is applicable to various forms including those described as examples below.

The example in which the fixed portion W, which is a welding mark of the support plate 73 and the blade portion 74, is formed continuously along the first direction has been described above. Alternatively, as illustrated in FIGS. 10A to 10D, the fixed portion W of the support plate 73 and the blade portion 74 can be formed intermittently along the first direction, and each fixed portion W can have any shape. Alternatively, the shape of the fixed portion W can be any shape such as those illustrated in FIGS. 10E to 10G.

In the configuration according to the present exemplary embodiment, the fixed portion W for fixing the support plate 73 and the blade portion 74 is formed by welding. Any welding methods can be used, and examples of specific welding methods that can be used include fiber laser welding and yttrium-aluminum-garnet (YAG) laser welding. Features of the fixing by welding are a high fixing strength and a small area required for fixing. If the area of the fixed portion W is large, there is a concern that the deformation of each end portion of the blade portion 74 in the first direction may be inhibited and reduced by the fixed portion W.

Thus, it is desirable to form the fixed portion W by welding because the blade portion 74 can be effectively deformed and the adhesion between the end portion seal member 25 and the regulation portion 75 can be increased. Furthermore, it is desirable that the blade portion 74 is welded to the support plate 73 along the rotational axis direction to form a welding mark and the welding mark is continuously formed similarly to the fixed portion W.

Further, while the color image forming apparatus 1 has been described in the first exemplary embodiment, the exemplary embodiments of the present disclosure are also applicable to a monochrome image forming apparatus.

The elements described in the above exemplary embodiments can be implemented in any combination.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. A color developing apparatus for use in a color image forming apparatus, the color developing apparatus comprising:

a developing frame configured to accommodate a color developer;

a developing member configured to bear the color developer and be rotatable; and a regulation blade configured to regulate the color developer borne on a surface of the developing member, wherein the regulation blade is fixed to the developing frame, wherein the regulation blade includes a support plate, a plate-shaped member, and a regulation member, wherein the support plate extends in a rotational axis direction of the developing member, wherein the plate-shaped member includes one end portion and another end portion in a direction intersecting with the rotational axis direction, wherein the one end portion faces the developing member and the other end portion is supported by the support plate, wherein the regulation member is configured to regulate the color developer borne on the surface of the developing member, is fixed to a facing surface of the plate-shaped member facing the developing member at the one end portion, is in contact with the developing member, and is formed inside an end portion of the plate-shaped member in the rotational axis direction, wherein, at the end portion in the rotational axis direction, the support plate is fixed to the developing frame by a fixing screw, and wherein the plate-shaped member is welded to a region of the support plate excluding a region where the fixing screw in the rotational axis direction is provided.

2. The color developing apparatus according to claim 1, wherein the plate-shaped member is welded to the support plate along the rotational axis direction to form a continuously formed welding mark.

3. The color developing apparatus according to claim 1, wherein the plate-shaped member is welded to the support plate along the rotational axis direction to form an intermittently formed welding mark.

4. The color developing apparatus according to claim 1, wherein the regulation member is flexible.

* * * * *